US008939788B2

(12) United States Patent
Eminovic et al.

(10) Patent No.: US 8,939,788 B2
(45) Date of Patent: Jan. 27, 2015

(54) CABLE CONNECTOR

(71) Applicants: Sal Eminovic, Milwaukee, WI (US); Darrell S. Filtz, Cedarburg, WI (US)

(72) Inventors: Sal Eminovic, Milwaukee, WI (US); Darrell S. Filtz, Cedarburg, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 72 days.

(21) Appl. No.: 13/753,233

(22) Filed: Jan. 29, 2013

(65) Prior Publication Data

US 2014/0213098 A1 Jul. 31, 2014

(51) Int. Cl.

| | |
|---|---|
| ***H01R 13/58*** | (2006.01) |
| ***H01R 13/59*** | (2006.01) |
| ***H01R 13/504*** | (2006.01) |
| ***H01R 43/26*** | (2006.01) |
| *H01R 13/10* | (2006.01) |
| *H01R 13/56* | (2006.01) |

(52) U.S. Cl.

CPC ..... *H01R 13/59* (2013.01); *H01R 13/5045* (2013.01); *H01R 13/5825* (2013.01); *H01R 43/26* (2013.01); *H01R 13/10* (2013.01); *H01R 13/562* (2013.01)

USPC ..... 439/465

(58) Field of Classification Search

USPC ..... 439/447, 465, 466, 464, 471

See application file for complete search history.

(56) References Cited

U.S. PATENT DOCUMENTS

| | | | | |
|---|---|---|---|---|
| 4,422,706 | A * | 12/1983 | Neuhouser | 439/465 |
| 5,315,062 | A * | 5/1994 | Hoshino | 439/446 |
| 5,749,746 | A | 5/1998 | Tan | |
| 5,831,815 | A * | 11/1998 | Miller et al. | 361/679.01 |
| 6,007,370 | A * | 12/1999 | Langridge | 439/455 |
| 6,413,112 | B2 | 7/2002 | Semmeling | |
| 6,416,351 | B1 * | 7/2002 | Ho | 439/447 |
| 6,540,547 | B2 * | 4/2003 | Zweigle | 439/468 |
| 6,962,504 | B2 * | 11/2005 | Fukui et al. | 439/466 |
| 6,971,905 | B2 * | 12/2005 | Makita et al. | 439/447 |
| 7,040,916 | B2 * | 5/2006 | Schmidt et al. | 439/460 |
| 7,476,121 | B2 * | 1/2009 | Tsuji | 439/471 |
| 7,520,195 | B2 * | 4/2009 | Dupont et al. | 74/502.4 |
| 7,614,902 | B2 * | 11/2009 | Bayat et al. | 439/446 |
| 7,670,169 | B1 * | 3/2010 | Pai | 439/465 |
| 7,815,445 | B2 * | 10/2010 | Wu et al. | 439/99 |
| 2004/0267109 | A1 | 12/2004 | Dancel | |
| 2005/0070148 | A1 | 3/2005 | Zhang | |

OTHER PUBLICATIONS

Byte Precabling Solution. Manual. Distributed by Weidmuller. Dated May 2011. pp. 1-36.

"Bulletin 1492 Digital/Analog Programmable Controller Wiring Systems." Technical Data Manual. Distributed by Rockwelll Automation. Dated 2009. pp. 1-196.

"Bulletin 1492 In-Panel I/O Wiring System Modules and Cables for Allen-Bradley Programmable Controllers." Manual. Distributed by Rockwell Automation. Dated 2009. pp. 1-8.

European Search Report for Application No. EP 14 15 3000, dated Apr. 29, 2014.

* cited by examiner

*Primary Examiner* — Gary Paumen

(74) *Attorney, Agent, or Firm* — Quarles & Brady LLP

(57) ABSTRACT

A cable connector for receiving a cable and a connector block. The cable connector including a first shell element with a first strain relief holding feature, a first connector block receiving feature, and a recess; a second shell element with a second strain relief holding feature, a second connector block receiving feature, and a projection; and a strain relief element defining a cable aperture sized to receive the cable, a compression collar, and a wing portion. The projection is received within the recess. The first and second strain relief holding features cooperate to support and maintain the strain relief element. The first and second connector block receiving features cooperate to support and maintain the connector block. The wing portion of the strain relief element is arranged to increase a holding ability of the strain relief element when a twisting or axial force is applied to the cable.

20 Claims, 20 Drawing Sheets

CABLE CONNECTOR

BACKGROUND

The present invention is directed to cable connectors for use with control systems. More specifically, the invention is directed to multi-pin cable connectors and their assembly.

Typically, multi-pin connectors are overmolded with a resin or other hard setting material. This overmolding surrounds all conductors in the cable and is in positive contact with the wires, pins, and sheathing. Such cables are mass produced and customization is limited. For example, pin/wire positions are set and may not be changed.

Existing cable connectors are provided with both ends of the cable terminating in an overmolded cable connector. For custom installations in a control environment, one end is often cut off to expose the individual wires. This operation introduces inefficiency and calculated loss.

BRIEF SUMMARY OF THE INVENTION

The present embodiments overcome the aforementioned problems by providing first and second shell elements and a strain relief element. The invention can be assembled and used without any overmolding, fasteners, or adhesives.

In one construction, the invention provides a cable connector for receiving a cable and a connector block. The cable connector includes: a first shell element that includes a first strain relief holding feature, a first connector block receiving feature, and a recess; a second shell element that includes a second strain relief holding feature, a second connector block receiving feature, and a projection; and a strain relief element that defines a cable aperture sized to receive the cable, a compression collar, and a wing portion. The projection of the second shell element is received within the recess of the first shell element, the first strain relief holding feature and the second strain relief holding feature cooperate to support and maintain the strain relief element in the cable connector, the first connector block receiving feature and the second connector block receiving feature cooperate to support and maintain the connector block in the cable connector, and the wing portion of the strain relief element is arranged to increase a holding ability of the strain relief element when a force is applied to the cable.

In another construction, the invention provides a method of assembling a cable connector to a cable and a connector block, wherein the cable connector includes: a first shell element with a first strain relief holding feature, a first connector block receiving feature, and a recess; a second shell element including a second strain relief holding feature, a second connector block receiving feature, and a projection; and a strain relief element defining a cable aperture sized to receive the cable, a compression collar, and a wing portion. The method includes inserting the cable through the cable aperture, wiring the cable to the connection block, positioning the strain relief element between the first shell element and the second shell element, positioning the connection block between the first shell element and the second shell element, engaging the strain relief element with the first strain relief holding feature and the second strain relief holding feature, inserting the projection of the second shell element into the recess of the first shell element, and sonic welding the first shell element to the second shell element.

In another construction, the invention provides a prewired cable assembly that includes a cable with a plurality of wires and a sheathing, and a connector block with a plurality of connection elements, each connection element in electrical communication with one of the plurality of wires and insulated from the other connection elements. A first shell element includes a first strain relief holding feature, a first connector block receiving feature, and a recess. A second shell element includes a second strain relief holding feature, a second connector block receiving feature, and a projection. A strain relief element defines a cable aperture sized to receive the cable, a compression collar, and a wing portion. The projection of the second shell element is received within the recess of the first shell element, the first strain relief holding feature and the second strain relief holding feature cooperate to support and maintain the strain relief element in the cable connector, the first connector block receiving feature and the second connector block receiving feature cooperate to support and maintain the connector block in the cable connector, and the wing portion of the strain relief element is arranged to increase a holding ability of the strain relief element when a force is applied to the cable.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

Figure 1:
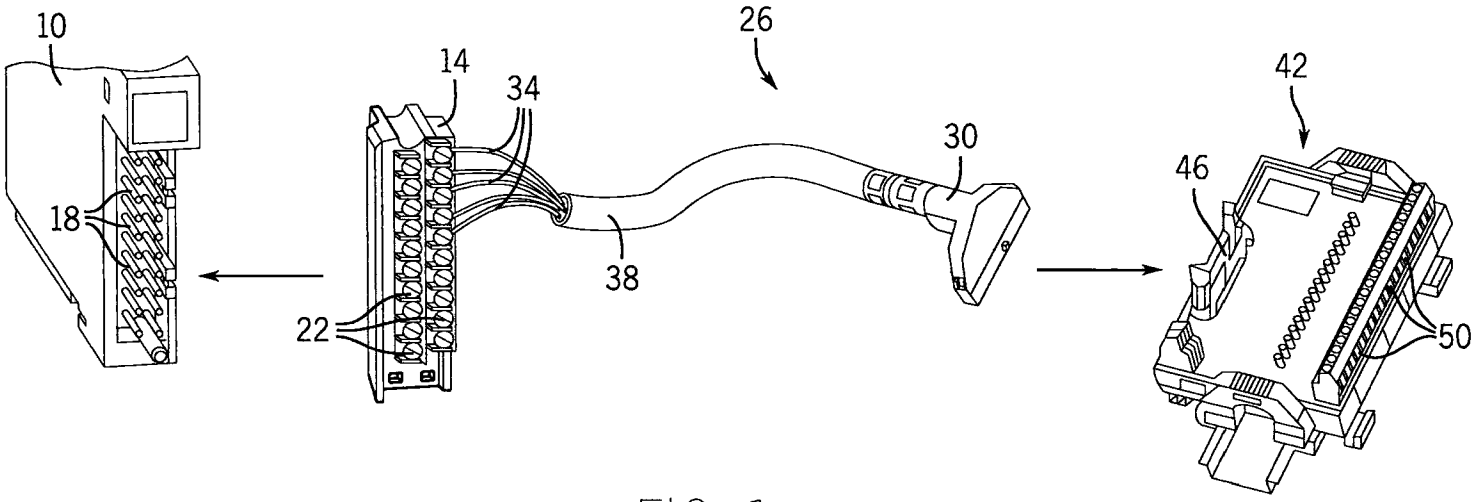
FIG. 1 is an exploded perspective view of a cable assembly, a Programmable Logic Controller (PLC), and an I/O board.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The present invention will be described in terms of one or more preferred embodiments, and it should be appreciated that many equivalents, alternatives, variations, and modifications, aside from those expressly stated, are possible and within the scope of the invention.

FIG. 1 shows an input/output (I/O) module 10 with a removable face plate 14. The I/O module 10 includes a plurality of pins 18 and the removable face plate 14 includes a matching number of screw connections 22 that interface with the pins 18 when the removable face plate 14 is installed on the I/O module 10.

A prewired cable 26 includes a cable connector 30, a plurality of wires 34, and a sheathing 38 surrounding the wires 34. The cable connector 30 includes a plurality of pins (not shown) each associated and in isolated communication with a corresponding wire 34.

An interface module (IFM) 42 includes a socket 46 for receiving the cable connector 30, and a plurality of connection points 50. The socket 46 includes a plurality of pin receiving sockets (not shown), each associated with a pin of the cable connector and in communication with a corresponding connection point 50.

The prewired cable 26 is arranged such that individual wires 34 may be wired as desired to the screw connections 22 of the I/O module 10 and easily communicated to the IFM 42 via the cable connection 30 and the socket 46. Such an arrangement simplifies a wiring cabinet or enclosure and makes instillation more reliable while increasing installation speed. Numerous advantages exist for using prewired cables, as is well known in the art.

Figure 2:
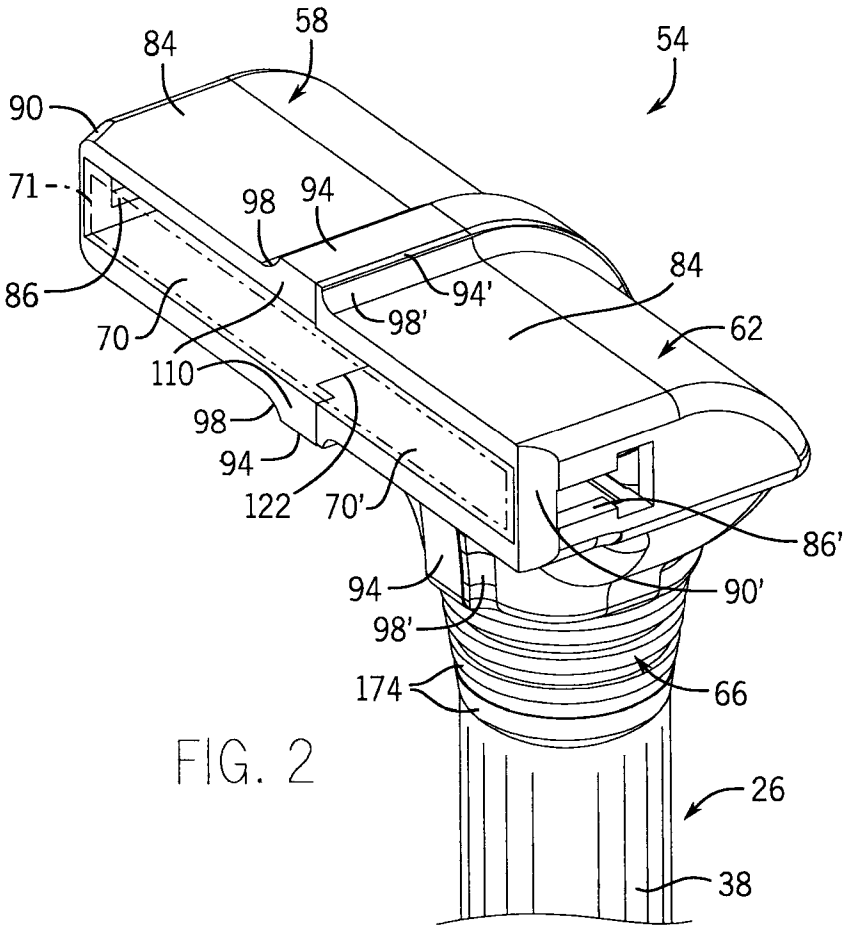
FIG. 2 is a front perspective view of a connector according to an embodiment of the invention.

Turning to FIG. 2, an exemplary inventive cable connector 54 is illustrated. The cable connector 54 includes a first shell element 58, a second shell element 62, and a strain relief element 66. The first and second shell elements 58, 62 may be constructed of Valox 357 or other U/L recognized material for electrical connectors.

Figure 12:
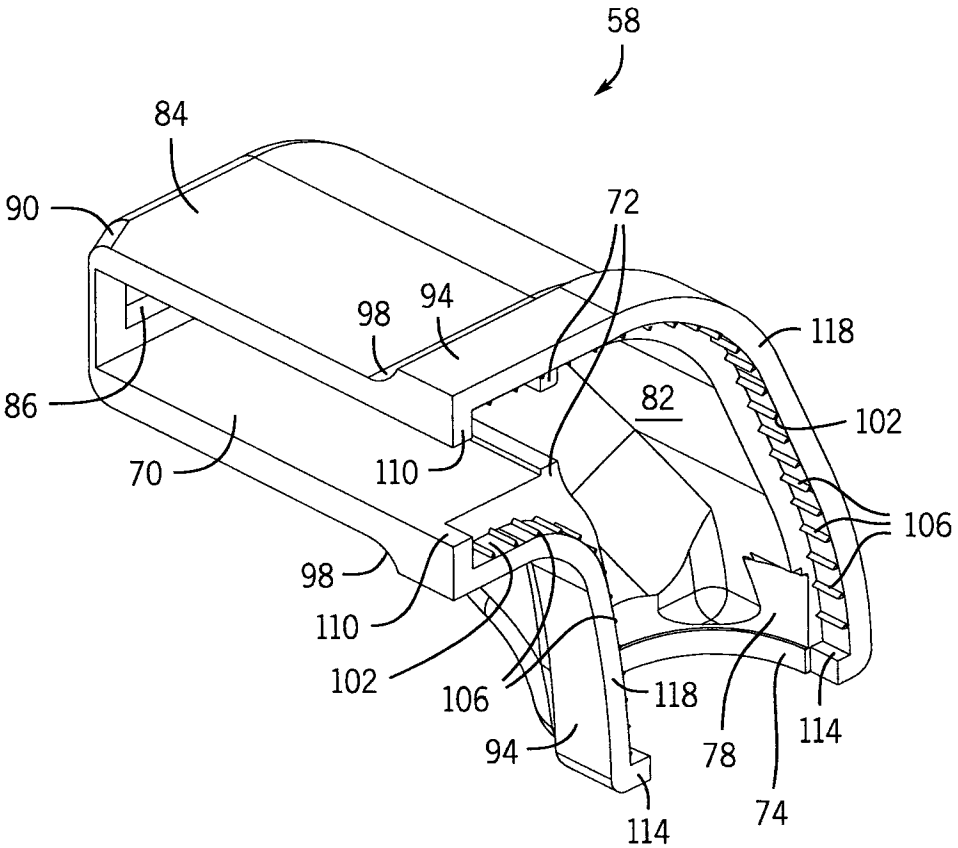
FIG. 12 is a perspective view of a first shell element of the connector of FIG. 2.

FIG. 12 shows the first shell element 58 in detail. The first shell element 58 includes a front or connection aperture 70 arranged to receive a pin block, or another connection block 71 such as a pin receiving block (see FIG. 18, the connection block 71 is shown in broken lines in FIG. 2). The connection block 71 includes a plurality of connection elements each associated with a single wire 34 of the cable 26 and insulated from the other connection elements. Connection blocks 71 are well known in the art and any desired block 71 may be suitably adapted for use with the inventive cable connector 54. For example, 20 pin and 40 pin connector blocks 71 may be used. Inward from the connection aperture 70 are arranged a pair of projections 72. When installed, the connection block 71 would abut the projections 72.

The first shell element 58 also includes a bottom or cable aperture 74 arranged to receive the strain relief element 66. Adjacent the cable aperture 74 is a collar recess 78 of slightly larger diameter than the cable aperture 74.

Between the connection aperture 70 and the cable aperture 74, a body cavity is defined by walls 82. The space within the body cavity provides room for the connection of wires to the connection block 71.

An outside surface 84 of the first shell element 58 includes a T-slot 86 arranged on a side surface substantially adjacent the connection aperture 70. The outside surface 84 also defines a guide portion 90 that aids in the installation of the cable connector 54 into the socket 46, and a raised rib 94 on both a top side of the outside surface 84 and an underside of the outside surface 84. A fillet 98 is positioned between the raised ribs 94 and the outside surface 84.

Coupling recesses 102 are defined in the raised ribs 94 and lined with energy concentrator ribs 106. The illustrated energy concentrator ribs 106 are triangular in cross section and extend the full depth of the coupling recess 102. The coupling recesses 102 terminate at a connection wall 110 adjacent the connection aperture 70 of the first shell element 58, and in a cable wall 114 adjacent the cable aperture 74.

The rightmost end of the first shell element 58 as viewed in FIG. 12, hereinafter referred to as the inside extremity, is not enclosed by a wall but is open. The inside extremity is defined by an inside surface 118 of the raised ribs 94.

Figure 13:
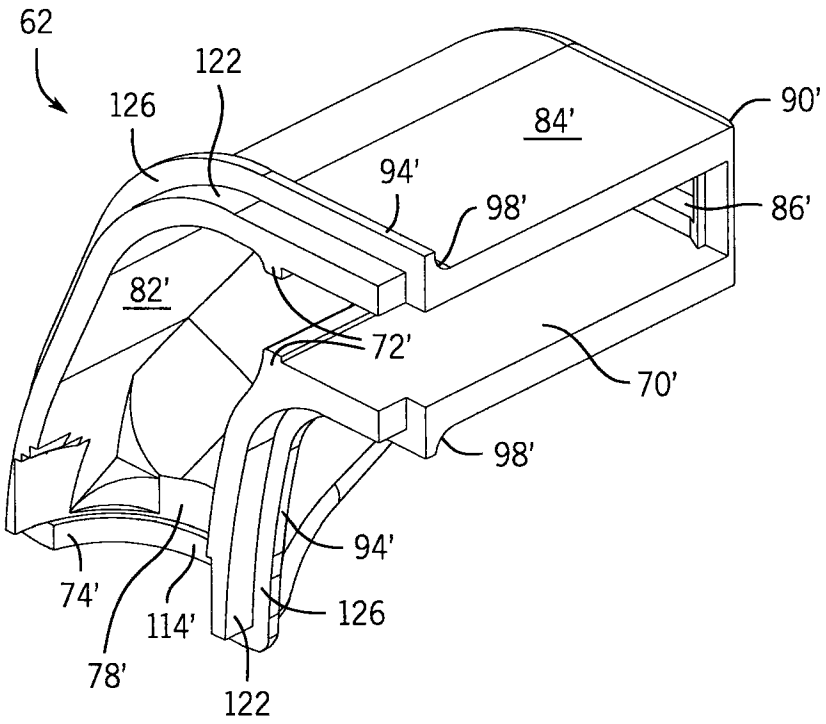
FIG. 13 is a perspective view of a second shell element of the connector of FIG. 2.

FIG. 13 shows the second shell element 62 in detail. The second shell element 62 includes a front or connection aperture 70' that, together with the connection aperture 70 of the first shell element 58, receives the connection block 71 (see FIG. 18). Inward from the connection aperture 70' are arranged a pair of projections 72'. When installed, the connection block 71 would abut the projections 72'.

The second shell element 62 also includes a bottom or cable aperture 74' arranged to receive the strain relief element 66. Adjacent the cable aperture 74' is a collar recess 78' of slightly larger diameter than the cable aperture 74'.

Between the connection aperture 70' and the cable aperture 74', a body cavity is defined by walls 82'. The space within the body cavity provides room for the connection of wires to the connection block 71.

An outside surface 84' of the second shell element 62 includes a T-slot 86' arranged on a side surface substantially adjacent the connection aperture 70'. The outside surface 84' also defines a guide portion 90' that aids in the installation of the cable connector 54 into the socket 46, and a raised rib 94' on both a top side of the outside surface 84' and an underside of the outside surface 84'. A fillet 98' is positioned between the raised ribs 94' and the outside surface 84'.

Projections 122 extend from the raised ribs 94' and are sized to be received in the recesses 102 of the first shell element 58 and to contact the energy concentrator ribs 106. The projections 122 are arranged such that the projections are received within the connection wall 110 and the cable wall 114. Additionally, a cable wall 114' is formed in the second shell element 62 corresponding with the cable wall 114 of the first shell element 58.

The leftmost end of the second shell element 62 as viewed in FIG. 13, hereinafter referred to as the inside extremity, is not enclosed by a wall but is open. The inside extremity is defined by an inside surface 126 of the raised ribs 94'. The inside surface 118 of the first shell element 58 abuts the inside surface 126 of the second shell element 62 when the cable connector 54 is assembled.

Figure 14:
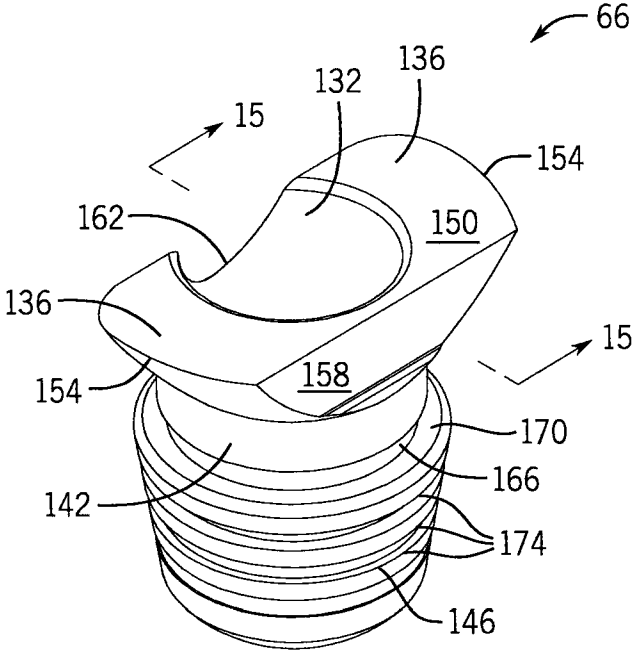
FIG. 14 is a perspective view of a strain relief element of the connector of FIG. 2.

FIG. 14 shows the strain relief element 66 in detail. The strain relief element 66 includes a cable aperture 132 sized to receive the cable 26, two wing portions 136, a compression ring portion 142, and a flexible skirt 146. The cable aperture 132 is sized such that the sheathing 38 of the cable 26 is in an interference fit relationship with the cable aperture 132. That is to say, a force must be used to install the strain relief element 66 onto the cable 26. The cable aperture 132 is sized for a specific cable 26 such that the interference fit can be controlled.

The wing portions 136 define a top surface 150 of the strain relief element 66 and extend to a wing diameter 154 that can be concentric with the cable aperture 132. From the wing diameter 154, the wing portions 136 extend downward at an oblique angle to the compression ring portion 142. A front surface 158 and a back surface 162 of the strain relief element 66 are shaped such that they fit within the body cavity of the first and second shell elements 58, 62 when the cable connector 54 is assembled (see FIG. 10).

The compression ring portion 142 defines a diameter that is larger than a diameter of the collar recesses 78, 78' of the first and second shell elements 58, 62 when the cable connector 54 is assembled. A height of the compression ring portion 142 is arranged to substantially fit within a height of the collar recesses 78, 78' of the first and second shell elements 58, 62.

Below the compression ring portion 142 is formed a recess 166 that receives the cable walls 114, 114' of the first and second shell elements 58, 62 when the cable connector 54 is assembled to maintain the strain relief element 66 in the assembly. An upper surface 170 of the flexible skirt 146 abuts the bottom of the cable walls 114, 114' of the first and second shell elements 58, 62 when the cable connector 54 is assembled.

The flexible skirt 146 defines a plurality of ribs or projections 174 and is able to flex with the movement of the cable 26 while supporting the cable 26 and providing support.

Figure 19:
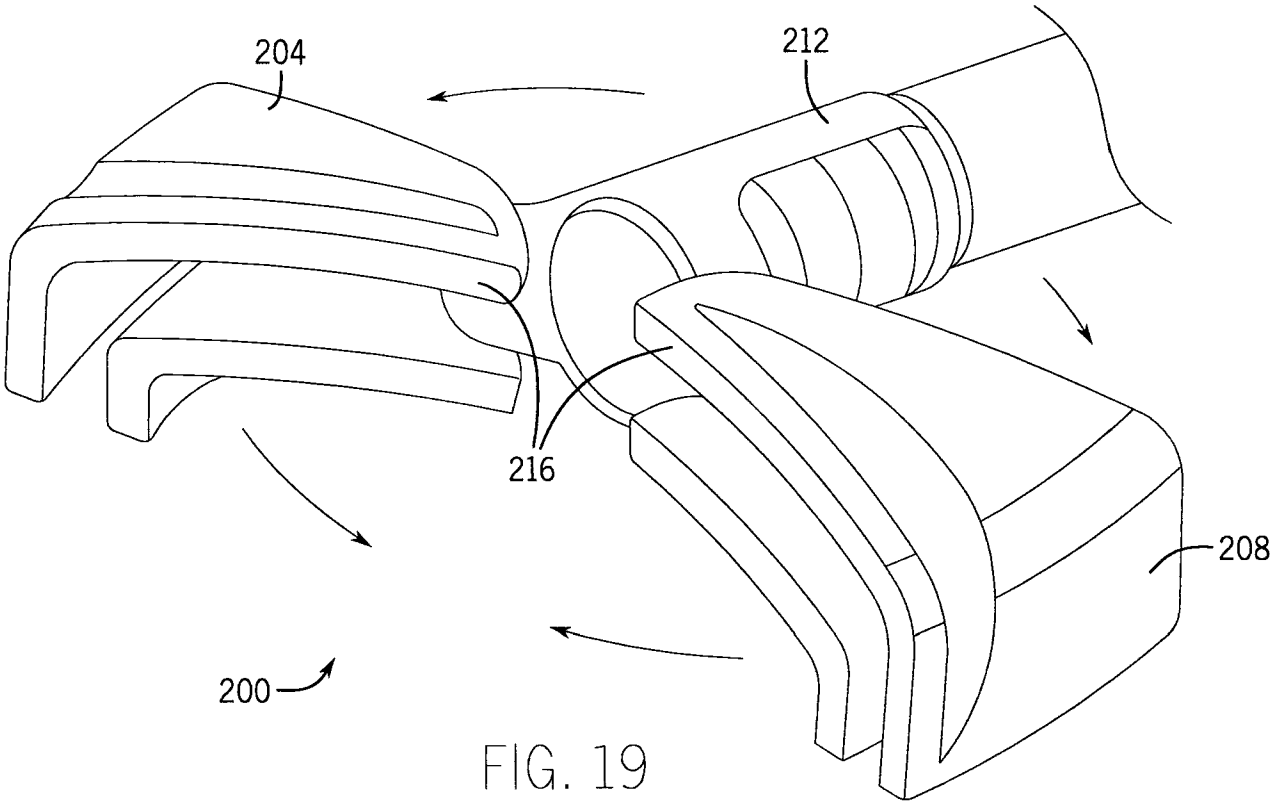
FIG. 19 is a perspective view of another connector according to an embodiment of the invention.

FIG. 19 shows an alternate construction of a cable connector 200 according to the invention. The cable connector 200 includes a first shell element 204 and a second shell element 208 coupled to a strain relief element 212 via living springs 216. The illustrated cable connector 200 is formed as a single piece. The two shell elements 204, 208 are rotated into engagement as shown by the arrows in FIG. 19. Once engaged, the two shell elements 204, 208 may be sonically welded together to complete assembly of the cable connector 200.

Figure 20:
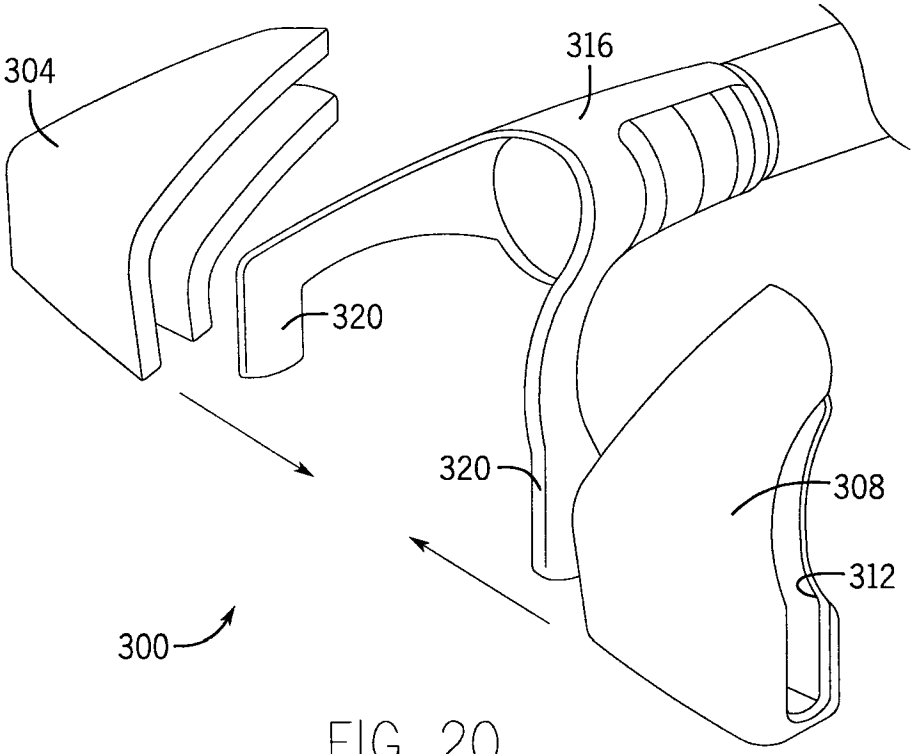
FIG. 20 is a perspective view of another connector according to an embodiment of the invention.

FIG. 20 shows an alternate construction of a cable connector 300 according to the invention. The illustrated cable connector 300 includes a first shell element 304 and a second shell element 308. Each shell element includes a side aperture 312 (only the side aperture 312 of the second shell element 308 is visible). A strain relief element 316 includes two arms 320 that are sized to engage the side apertures 312 of the first and second shell elements 304, 308. During assembly, the two shell elements 304, 308 may be brought together as shown by the arrows in FIG. 20 and sonically welded together. As discussed above, other joining techniques and methods may be used as desired.

Figure 18:
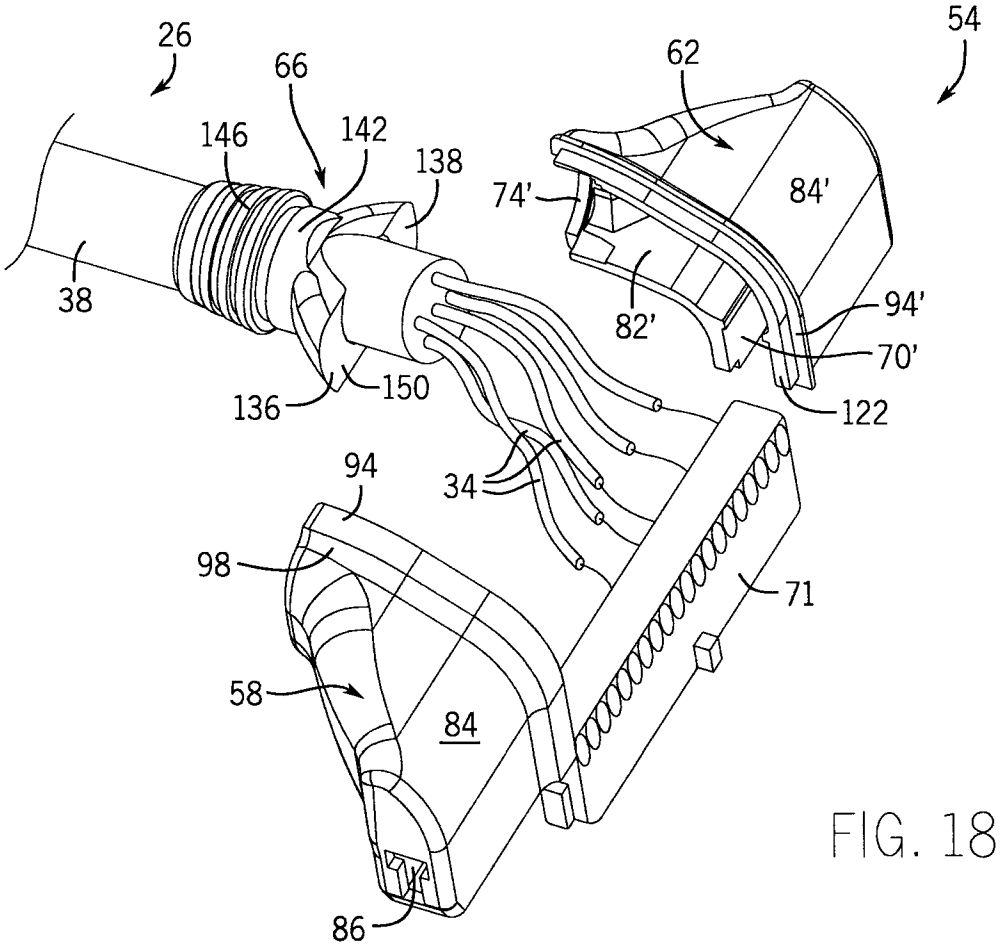
FIG. 18 is an exploded view of the connector of FIG. 2.

Assembly of the cable connector 54 will be described with reference to FIG. 18. To begin assembly, a cable 26 is selected with the desired number of conductors or wires 34 and the desired sheathing 38. The strain relief element 66 is then forced onto the cable sheathing 38. The cable aperture 132 should snugly engage the sheathing 38. The wires 34 are then fixed to the desired pins on the connection block 71.

With the connection block 71 wired and the strain relief element 66 mounted on the sheathing 38, the first and second shell elements 58, 62 are brought together from opposing directions to close around the strain relief element 66, the wires 34, and the connection block 71. The recess 166 of the strain relief element 66 is engaged by the cable walls 114, 114' of the first and second shell elements 58, 62 while the compression ring portion 142 is compressed by the collar recesses 78, 78' of the first and second shell elements 58, 62. The compression increases the friction force exerted on the sheathing and helps maintain the cable 26 in position relative to the strain relief element 66.

The projections 122 of the second shell element 62 are received within the recesses 102 of the first shell element 58 with the energy concentrator ribs 106 engaging the projections 122. When the inside surface 118 of the first shell element 58 contacts the inside surface 126 of the second shell element 62, the joint can be sonic welded together. Other connection methods are possible. For example, an epoxy or adhesive may be used. The energy concentrator ribs 106 aid the sonic welding and provide a superior joint.

With the first and second shell elements 58, 62 sonic welded together, the assembly is complete and the cable connector 54 may be used as intended. The strain relief element 66 maintains the cable 26 in position via friction in the cable aperture 132 and via action of the wing portions 136. When a pulling force is applied to the cable 26, the wing portions 136 may flex inward with the pulling force, thereby applying a large friction force and constricting about the cable 26. Further, a twisting action on the cable 26 will cause the wing portions 136 to flex and also increase the friction force, thereby resisting movement. This flexing action inhibits removal or slippage of the cable 26.

The above described invention provides an easily customizable cable connector. The body cavity within the first and second shell elements 58, 62 may not be filled with polymer or other substance and is not subject to electrical crossover, interference, or accidental conduction between wires 34 or pins. The cable connector 54 is easy to assemble for various connector blocks or pin arrangements. Further, the diameter of cable used with the cable connector 54 can easily be changed by simply altering the diameter of the cable aperture 132 in the strain relief element 66.

Figure 3:
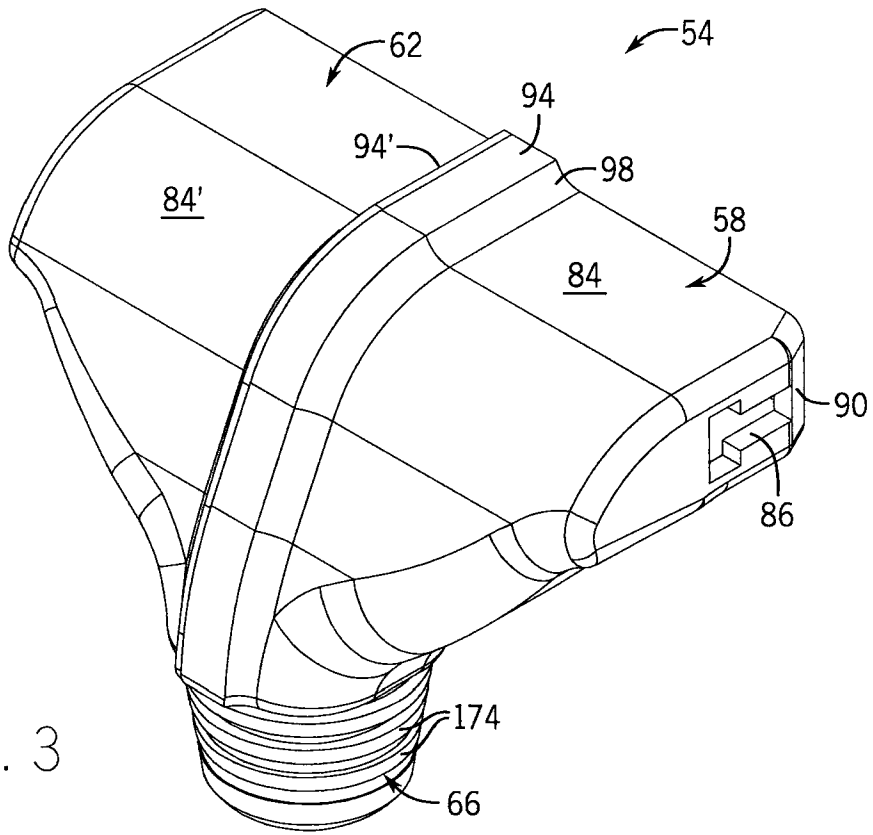
FIG. 3 is a rear perspective view of the connector of FIG. 2.
Figure 4:
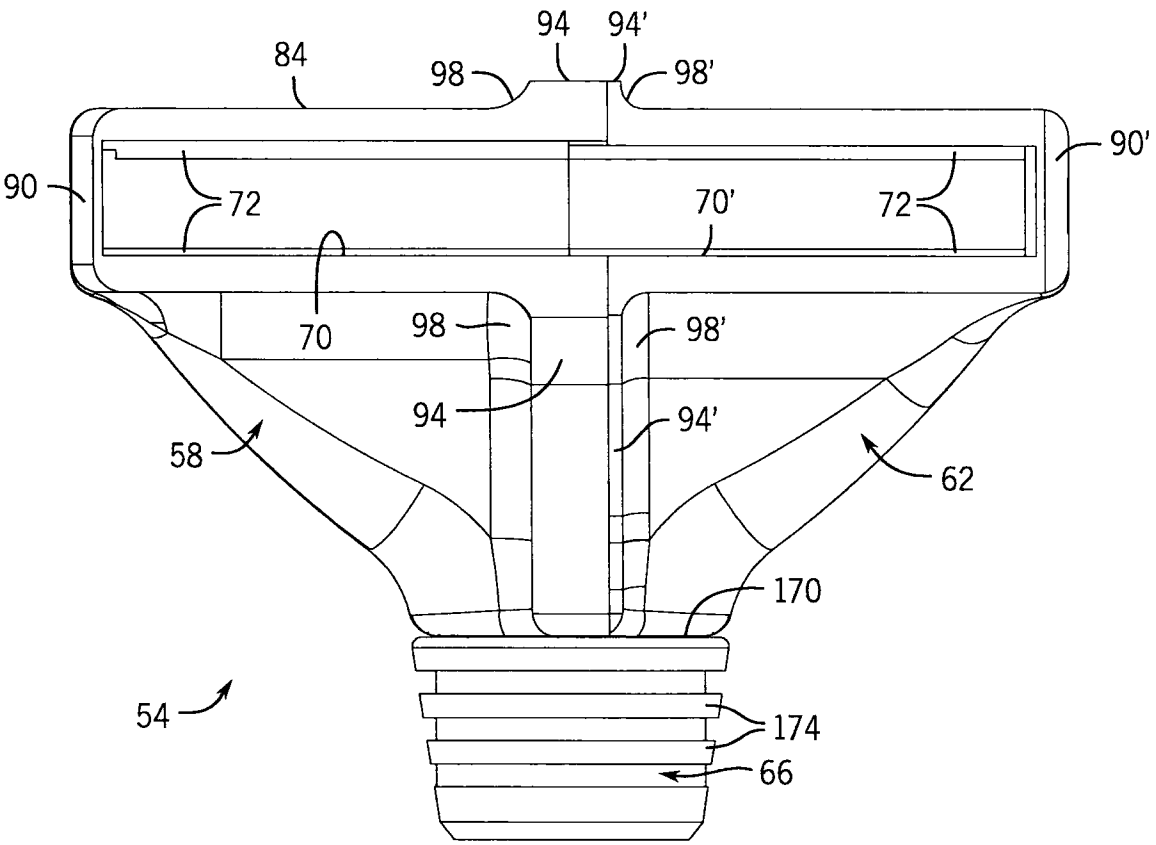
FIG. 4 is a front view of the connector of FIG. 2.
Figure 5:
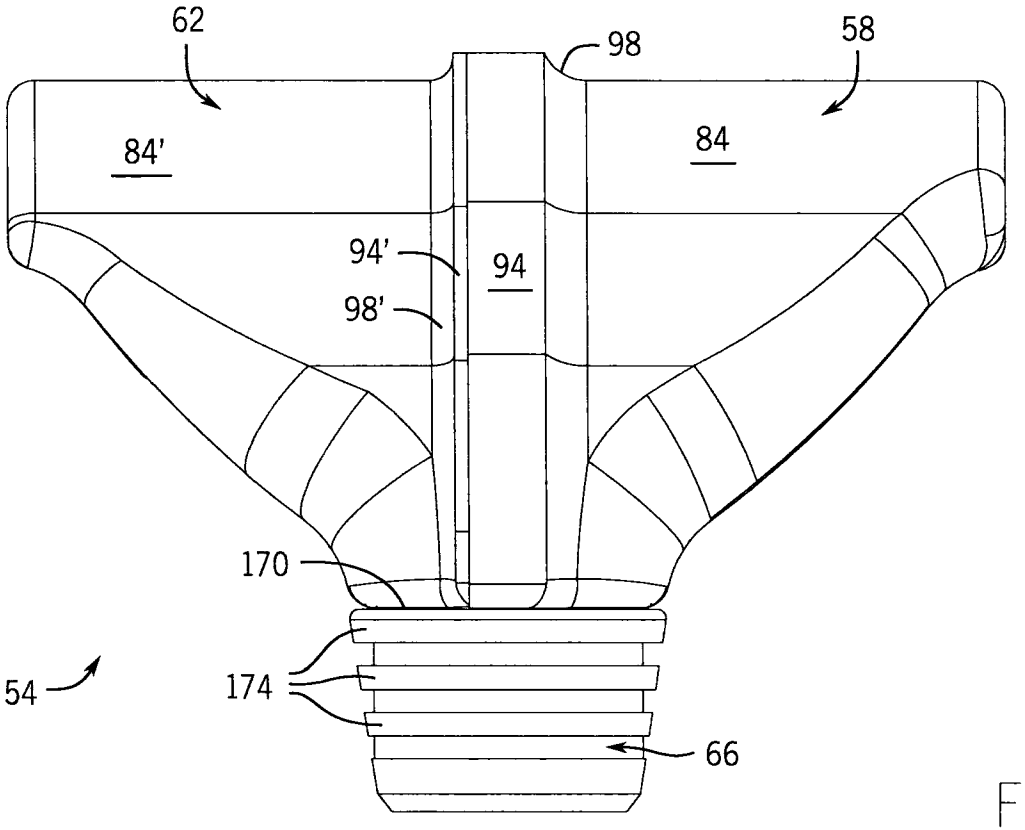
FIG. 5 is a rear view of the connector of FIG. 2.
Figure 6:
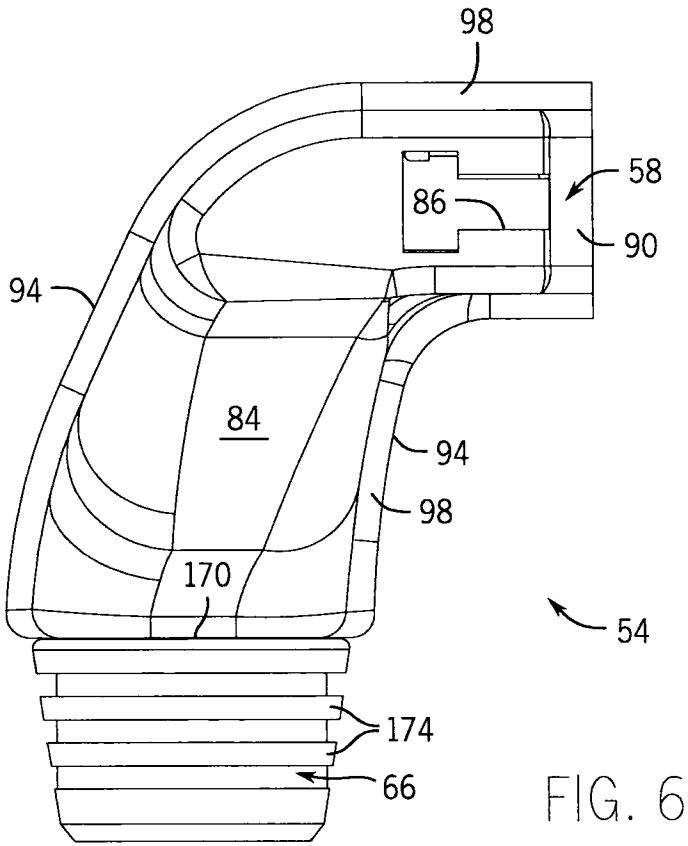
FIG. 6 is a left side view of the connector of FIG. 2.
Figure 7:
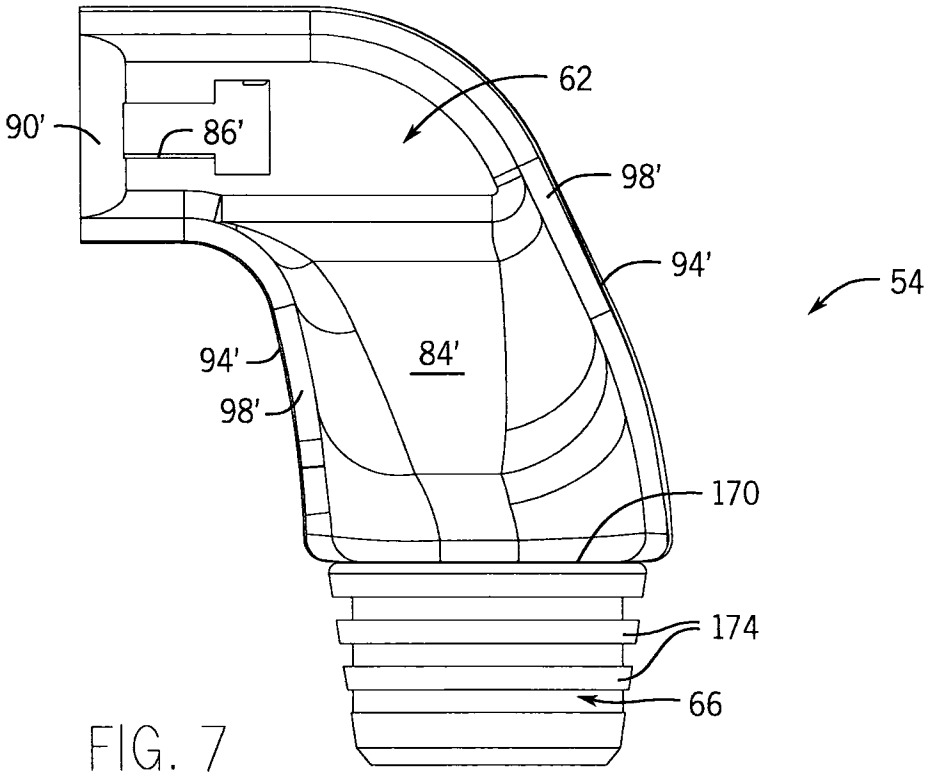
FIG. 7 is a right side view of the connector of FIG. 2.
Figure 8:
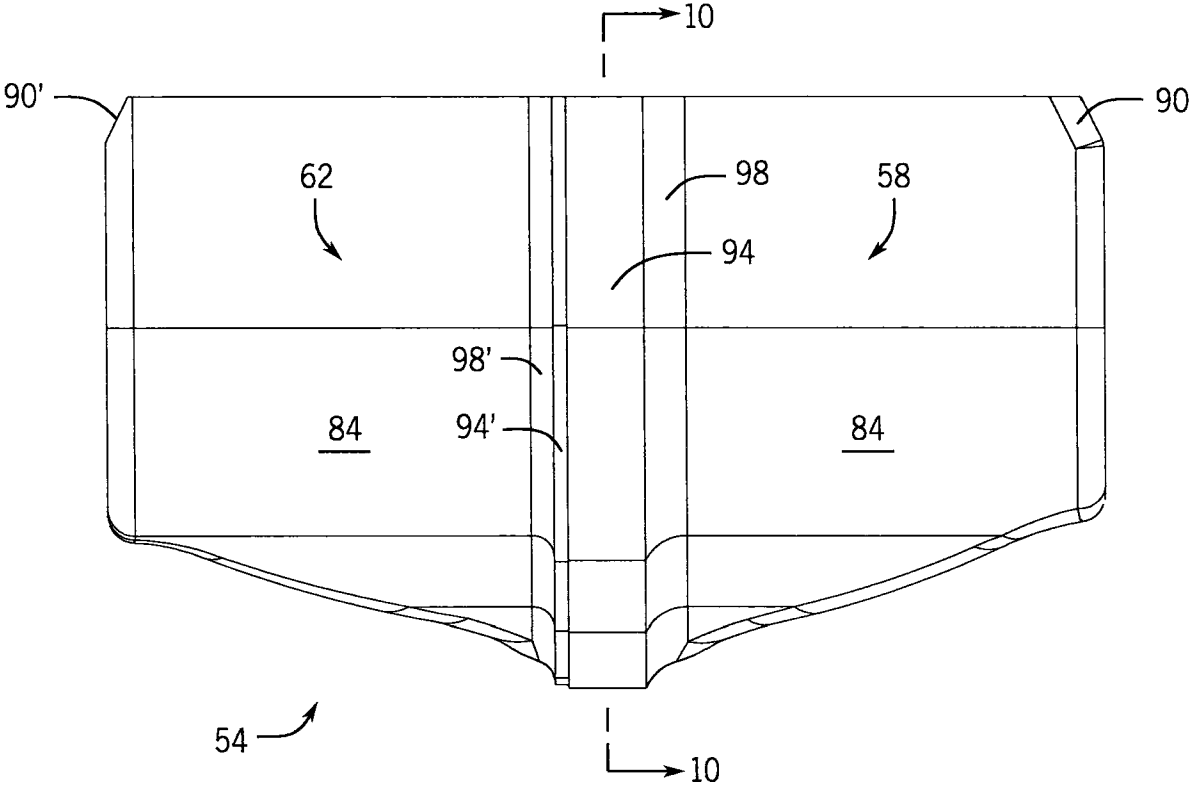
FIG. 8 is a top view of the connector of FIG. 2.
Figure 9:
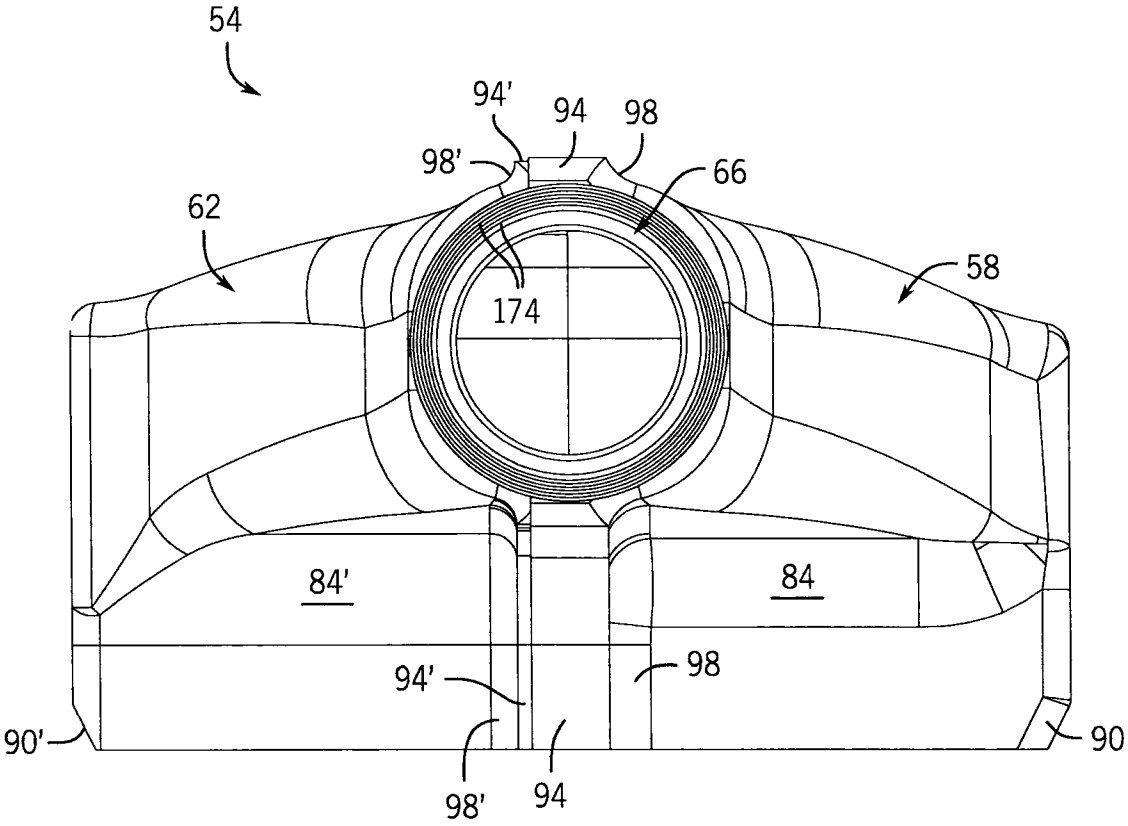
FIG. 9 is a bottom view of the connector of FIG. 2.
Figure 10:
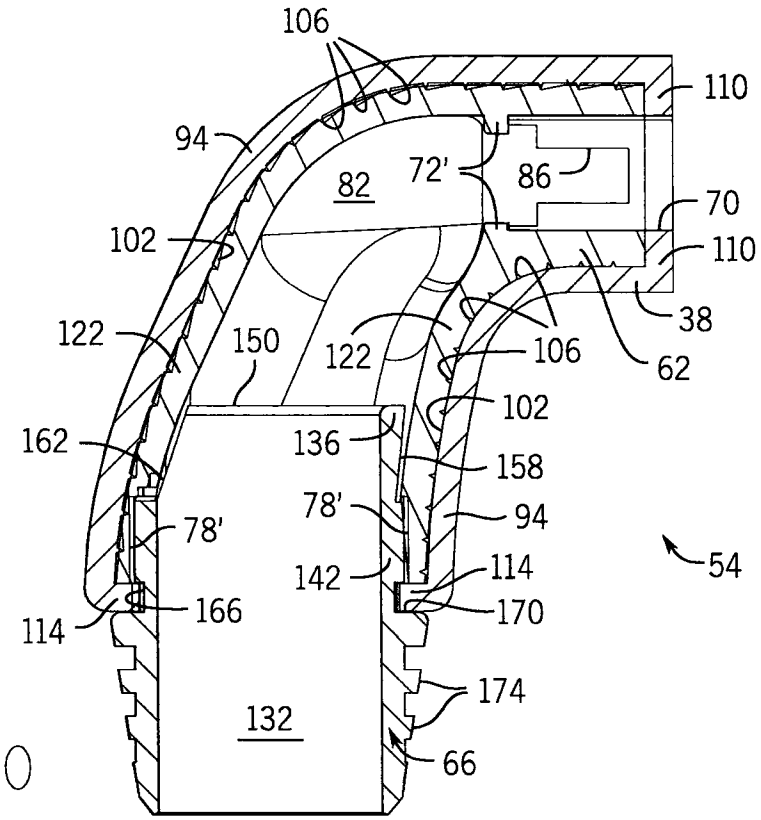
FIG. 10 is a section view of the connector of FIG. 2 taken along line 10-10 in FIG. 8.
Figure 11:
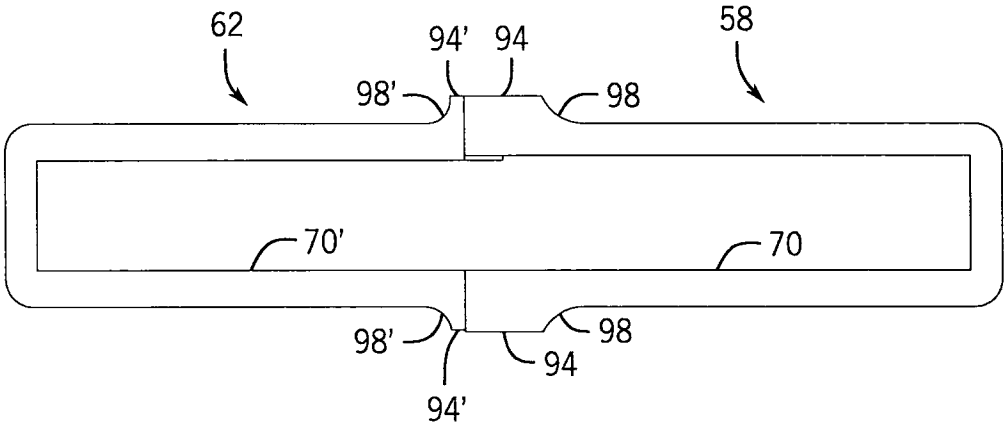
FIG. 11 is a plan view of a connection profile of the connector of FIG. 2.
Figure 15:
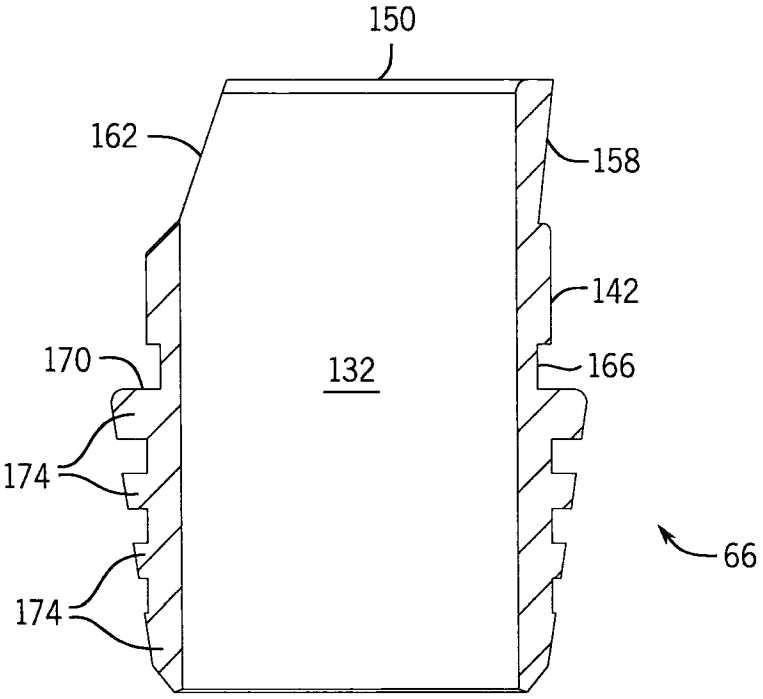
FIG. 15 is a section view of the strain relief element of FIG. 14 taken along line 15-15.
Figure 16:
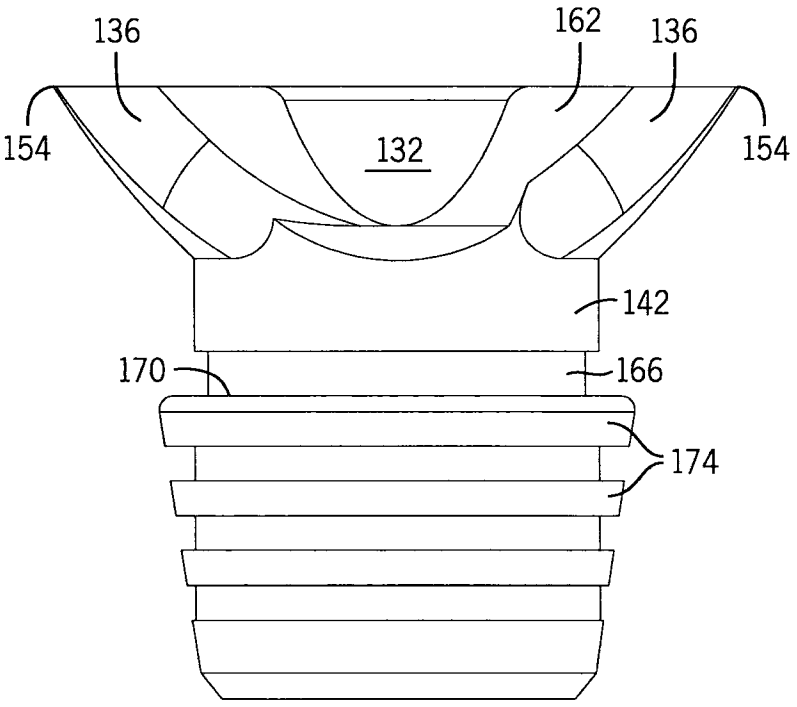
FIG. 16 is a front view of the strain relief element of FIG. 14.
Figure 17:
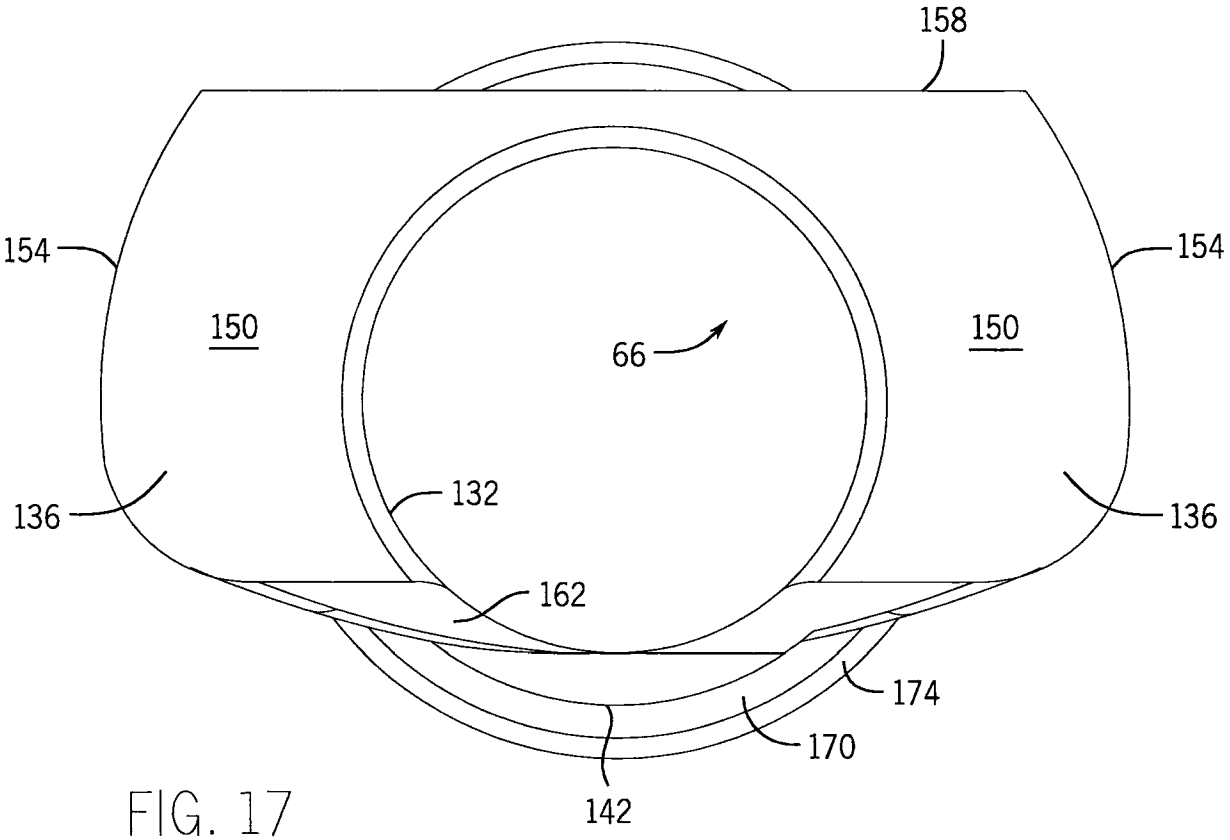
FIG. 17 is a top view of the strain relief element of FIG. 14.

Several other views of exemplary cable connectors are provided. FIG. 3 is a rear perspective view of the cable connector 54. FIG. 4 is a front view of the cable connector 54. FIG. 5 is a rear view of the cable connector 54. FIG. 6 is a left side view of the cable connector 54. FIG. 7 is a right side view of the cable connector 54. FIG. 8 is a top view of the cable connector 54. FIG. 9 is a bottom view of the cable connector 54. FIG. 10 is a section view of the cable connector 54 taken along line 10-10 in FIG. 8. FIG. 11 is a plan view of a connection profile of the cable connector 54. FIG. 15 is a section view of the strain relief element 66. FIG. 16 is a front view of the strain relief element 66. FIG. 17 is a top view of the strain relief element 66.

In other constructions, the cable connector 54 could have a different outward appearance, or be a straight connector. Other constructions are possible in view of the following claims.

We claim:

1. A cable connector for receiving a cable and a connector block, the cable connector comprising:

a first shell element including a first strain relief holding feature, a first connector block receiving feature, and a recess;

a second shell element including a second strain relief holding feature, a second connector block receiving feature, and a projection; and a strain relief element defining a cable aperture sized to receive the cable, a compression collar, and a wing portion, wherein the projection of the second shell element is received within the recess of the first shell element, wherein the first strain relief holding feature and the second strain relief holding feature cooperate to support and maintain the strain relief element in the cable connector, wherein the first connector block receiving feature and the second connector block receiving feature cooperate to support and maintain the connector block in the cable connector, and wherein the wing portion of the strain relief element is arranged to increase a holding ability of the strain relief element when a force is applied to the cable.

2. The cable connector of claim 1, wherein first shell element is sonically welded to the second shell element.

3. The cable connector of claim 1, wherein the recess of the first shell element includes ribs that engage the projection of the second shell element.

4. The cable connector of claim 3, wherein the ribs are energy concentrator ribs, and wherein the first shell element is sonically welded to the second shell element and the energy concentrator ribs focus the energy of the sonic welding operation to provide a consistent weld joint.

5. The cable connector of claim 1, wherein assembly of the cable connector occurs without the use of fasteners or adhesives.

6. The cable connector of claim 1, wherein assembly of the cable connector occurs without over molding.

7. The cable connector of claim 1, wherein the cable aperture is sized for an interference fit with the cable.

8. The cable connector of claim 1, wherein the wing portion extends radially away from the cable aperture and is flexible.

9. The cable connector of claim 1, wherein the wing portion flexes in response to at least one of a twisting force and an axial force on the cable, the flex increasing the friction force applied by the strain relief element on the cable.

10. The cable connector of claim 1, wherein the compression collar is compressed by the first shell element and the second shell element to constrict the cable within the strain relief element and increase the friction therebetween.

11. The cable connector of claim 1, wherein the first strain relief holding feature is a first wall and the second strain relief holding feature is a second wall, wherein the strain relief element includes a wall recess that receives the first wall and the second wall to maintain the strain relief element in the cable connector.

12. The cable connector of claim 1, wherein the strain relief element further includes a flexible skirt that extends beyond the first shell element and the second shell element and provides support for the cable.

13. A method of assembling a cable connector to a cable and a connector block, the cable connector including, a first shell element with a first strain relief holding feature, a first connector block receiving feature, and a recess, a second shell element including a second strain relief holding feature, a second connector block receiving feature, and a projection, and a strain relief element defining a cable aperture sized to receive the cable, a compression collar, and a wing portion, wherein the wing portion of the strain relief element is arranged to increase a holding ability of the strain relief element when a force is applied to the cable, the method comprising:

inserting the cable through the cable aperture;

wiring the cable to the connection block;

positioning the strain relief element between the first shell element and the second shell element;

positioning the connection block between the first shell element and the second shell element;

engaging the strain relief element with the first strain relief holding feature and the second strain relief holding feature;

inserting the projection of the second shell element into the recess of the first shell element; and sonic welding the first shell element to the second shell element.

14. The method of claim 13, wherein inserting the cable through the cable aperture includes forcing the cable through an interference fit with the cable aperture.

15. The method of claim 13, wherein the entire method is carried out in a single location.

16. A prewired cable assembly comprising:

a cable including a plurality of wires and a sheathing;

a connector block including a plurality of connection elements, each connection element in electrical communication with one of the plurality of wires and insulated from the other connection elements;

a first shell element including a first strain relief holding feature, a first connector block receiving feature, and a recess;

a second shell element including a second strain relief holding feature, a second connector block receiving feature, and a projection; and a strain relief element defining a cable aperture sized to receive the cable, a compression collar, and a wing portion, wherein the projection of the second shell element is received within the recess of the first shell element, wherein the first strain relief holding feature and the second strain relief holding feature cooperate to support and maintain the strain relief element in the cable connector, wherein the first connector block receiving feature and the second connector block receiving feature cooperate to support and maintain the connector block in the cable connector, and wherein the wing portion of the strain relief element is arranged to increase a holding ability of the strain relief element when a force is applied to the cable.

17. The prewired cable assembly of claim 16, wherein first shell element is sonically welded to the second shell element.

18. The prewired cable assembly of claim 16, wherein assembly of the prewired cable assembly occurs without the use of fasteners or adhesives.

19. The prewired cable assembly of claim 16, wherein assembly of the prewired cable assembly occurs without over molding.

20. The prewired cable assembly of claim 16, wherein the wing portion flexes in response to at least one of a twisting force and an axial force on the cable, the flex increasing the friction force applied by the strain relief element on the cable.

* * * * *